US011751627B2

(12) United States Patent
Cho et al.

(10) Patent No.: US 11,751,627 B2
(45) Date of Patent: Sep. 12, 2023

(54) VIBRATION GENERATOR AND SHOE HAVING SAME

(71) Applicants: Jae Hoon Cho, Busan (KR); Ying Zhu Li, Beijing (CN); Yong Chen, Beijing (CN)

(72) Inventors: Jae Hoon Cho, Busan (KR); Ying Zhu Li, Beijing (CN); Yong Chen, Beijing (CN)

(73) Assignees: Jae Hoon Cho, Busan (KR); Ying Zhu Li, Beijing (CN); Yong Chen, Beijing (CN)

( * ) Notice: Subject to any disclaimer, the term of this patent is extended or adjusted under 35 U.S.C. 154(b) by 723 days.

(21) Appl. No.: 16/962,025

(22) PCT Filed: Jan. 23, 2018

(86) PCT No.: PCT/KR2018/000976
§ 371 (c)(1),
(2) Date: Jul. 14, 2020

(87) PCT Pub. No.: WO2019/142959
PCT Pub. Date: Jul. 25, 2019

(65) Prior Publication Data

US 2020/0359735 A1 Nov. 19, 2020

(30) Foreign Application Priority Data

Jan. 19, 2018 (KR) ..... 10-2018-0006996

(51) Int. Cl.
*A43B 7/1455* (2022.01)
*B06B 1/08* (2006.01)
*A61H 23/00* (2006.01)

(52) U.S. Cl.
CPC ..... *A43B 7/1455* (2013.01); *A61H 23/00* (2013.01); *B06B 1/085* (2013.01); *A61H 2205/12* (2013.01)

(58) Field of Classification Search
CPC ..... A43B 1/0054; A43B 7/146; A61H 1/00; A61H 1/001; A61H 1/003; A61H 1/005;
(Continued)

(56) References Cited

U.S. PATENT DOCUMENTS 5,913,838 A * 6/1999 Reilly ..... A61H 23/02 36/141
2010/0139124 A1* 6/2010 Kim ..... A43B 1/0054 36/105

(Continued)

FOREIGN PATENT DOCUMENTS

JP 2010-525918 A 7/2010
JP 2012-525196 A 10/2012

(Continued)

OTHER PUBLICATIONS

International Search Report for PCT/KR2018/000976 dated Oct. 17, 2018 from Korean Intellectual Property Office.

*Primary Examiner* — Samchuan C Yao
*Assistant Examiner* — Nathan M Le
(74) *Attorney, Agent, or Firm* — Paratus Law Group, PLLC

(57) ABSTRACT

Disclosed is a vibration generator for shoes, including: a flat vibration plate having a length longer than the width thereof; support pieces horizontally protruding in the widthwise direction of the vibration plate; upper and lower casings coupled while restricting each end portion of each support piece, so as to accommodate the vibration plate therein; core magnets fixedly provided in one or more places among the respective end portions in the lengthwise direction of the vibration plate; upper magnets fixed to the upper casing so (Continued)

as to face the core magnets, thereby generating a repulsive force; and bottom magnets fixed to the lower casing so as to face the core magnets, thereby generating a repulsive force.

11 Claims, 8 Drawing Sheets

(58) Field of Classification Search
CPC .... A61H 1/006; A61H 1/008; A61H 15/0078; A61H 39/04; B06B 1/045; Y10T 74/10; H02N 15/00; H02K 33/00; H02K 33/02
See application file for complete search history.

(56) References Cited

U.S. PATENT DOCUMENTS

| | | | | |
|---|---|---|---|---|
| 2012/0030970 | A1* | 2/2012 | Kim | A43B 1/0054 36/25 R |
| 2012/0169422 | A1* | 7/2012 | Fiocchi | H03G 1/0035 330/257 |

FOREIGN PATENT DOCUMENTS

| | | | |
|---|---|---|---|
| KR | 10-0941369 | B1 | 2/2010 |
| KR | 10-2011-0067903 | A | 6/2011 |
| KR | 10-1231022 | B1 | 2/2013 |
| KR | 10-1654247 | B1 | 9/2016 |

* cited by examiner

*- Prior Art -*

*- Prior Art -*

*- Prior Art -*

VIBRATION GENERATOR AND SHOE HAVING SAME

CROSS-REFERENCE TO PRIOR APPLICATIONS

This application is a National Stage Patent Application of PCT International Patent Application No. PCT/KR2018/000976 (filed on Jan. 23, 2018) under 35 U.S.C. § 371, which claims priority to Korean Patent Application No. 10-2018-0006996 (filed on Jan. 19, 2018), which are all hereby incorporated by reference in their entirety.

BACKGROUND

The present invention relates to a vibration generator that is capable of providing beneficial effects to a human body and, in particular, to a vibrator generator and a shoe having the same, the generator being accommodated in the shoe to generate vibration when a user walks, thereby providing effects of stimulating through a user's sole.

The foot is the most important body part involved in walking. Medically, the sole of the foot is known to be connected to various organs, so the foot is also called the second heart. Shoes function to wrap and protect the feet, but may sometimes cause various diseases, because the foot may be injured and blood circulation in the feet does not work properly as a user walks with the shoes on. In addition, since air circulation is not smooth in a state that the user wears shoes, various skin diseases such as athlete's foot may easily occur. Therefore, a vibrator accommodated in the shoe is used for the purpose of providing beneficial effects to the body, such as reducing foot fatigue. As a representative example in the related art, there is Korean Patent No. 10-1231022 titled "Shoe having vibration generating means accommodated therein".

FIG. 1 is an overall perspective view showing a shoe having a vibration generating means accommodated therein according to the prior art; FIG. 2 is an exploded perspective view showing the vibration generating means applied to FIG. 1; and FIG. 3 is a cross-sectional view showing the vibration generating means. As shown, the vibration generating means in the related art has a vibration plate 54 embedded between the upper case 51*a* and the lower case 51*b*. The vibration plate 54 is in a track shape as a whole, in which three vibration plates 54*a* are arranged parallel to each other in a lengthwise direction. Each vibration plate is supported by the upper and lower cases at one end portion thereof and has a free end portion at the other end portion thereof. In addition, vibration magnet bodies 55 are provided in free end portions of the vibration plates 54*a*, in which an upper magnet body 52 is provided in the upper case 51*a* and the lower magnet body 53 is provided in the lower case 51*b*, in opposite to each of the vibration magnet bodies 55. Meanwhile, the upper magnet and the lower magnet have magnetic poles formed with respect to the vibrating magnet bodies, thereby generating repulsive forces. When the user walks while wearing shoes, the vibration plate moves up and down rapidly, thereby causing vibration. In the case of the vibration generating means in the related art, each shaking table constituting the vibration plate has a fixed end portion at one end and a free end portion at the other end, so that vibration is induced only at the free end of the shaking table, whereby it is difficult to generate sufficient vibration. Therefore, the user can not sufficiently feel the effect of the vibration generating means.

SUMMARY

Accordingly, the present invention has been made keeping in mind the above problems occurring in the related art, and the present invention has an objective to provide a vibration generator having a new structure, which is capable of generating larger vibration while minimizing the size of a vibration generator accommodated in a shoe or the like. In addition, the present invention has an objective to provide a shoe having a vibration generator, the vibration generator being accommodated in a sole to provide beneficial effects such as blood flow improvement as a user receives the vibration through his/her feet by simply enjoying walking with the shoes on.

In order to achieve the above objective, a vibration generator according to the present invention includes a vibration plate of a plate type having a length longer than a width thereof; support pieces horizontally protruding in a widthwise direction of the vibration plate; upper and lower casings coupled while restricting each end portion of each support piece, so as to accommodate the vibration plate therein; core magnets fixedly provided in one or more of end portions in a lengthwise direction of the vibration plate; upper magnets fixed to the upper casing so as to face the core magnets, thereby generating a repulsive force; bottom magnets fixed to the lower casing so as to face the core magnets, thereby generating a repulsive force. Preferably, the vibration plate may be accommodated in a suspending state inside the upper and lower casings. Preferably, the vibration plate may be horizontally asymmetric. Preferably, the vibration plate may include two or more vibration plates provided in parallel. Preferably, the vibration plate may be provided so that inward portions of a first vibration plate and a second vibration plate are connected by a shared support piece. Preferably, the shared support piece may be supported by a support block protruding along a center line of the upper and lower casings. Preferably, the shared support piece may be provided so that an extension piece extends from the shared support piece in an intersecting manner, in which the extension piece is also supported by the support block. The vibration plate may be provided so that the first vibration plate and the second vibration plate are arranged in parallel, and the support piece may be formed near any end portion in a lengthwise direction of a first vibration plate and a second vibration plate. Preferably, the support piece protruding from the first vibration plate and the support piece protruding from the second vibration plate may be formed in opposite directions to each other, and inward portions of the support pieces may be supported by a support block protruding along a center line of the upper and lower casings. Preferably, the inward portions of the support pieces may be interconnected by a long connecting piece, in which the connecting piece is supported by the support block. Meanwhile, a shoe having the vibration generator according to other aspect of the present invention is provided so that the vibration generator is accommodated in the sole of the shoe composed of an upper and a sole.

According to the present invention, when the vibration generator is accommodated in clothes or footwear worn by a human body, such as shoes, the vibration generator generates the vibration due to magnetic force as a user moves, and the user receives the vibration transmitted by the vibration generator through his/her sole and thus is stimulated, which is the effect of providing benefits to his/her body. In particular, there is an effect of improving blood circulation through vibrations due to magnetic forces generated by the vibration generator according to the present invention. In addition, since the vibration generator according to the present invention can generate larger vibration compared to the related art, there are advantages that the size of the vibration generator can be reduced and the reliability of the product can be increased because the user can feel sufficient vibrations generated by the vibration generator. In addition, the vibration generator according to the present invention has an effect that the vibration duration is longer because both sides of the vibration plate are free end portions so that vibrations are generated at both sides.

DETAILED DESCRIPTION

Figure 1:
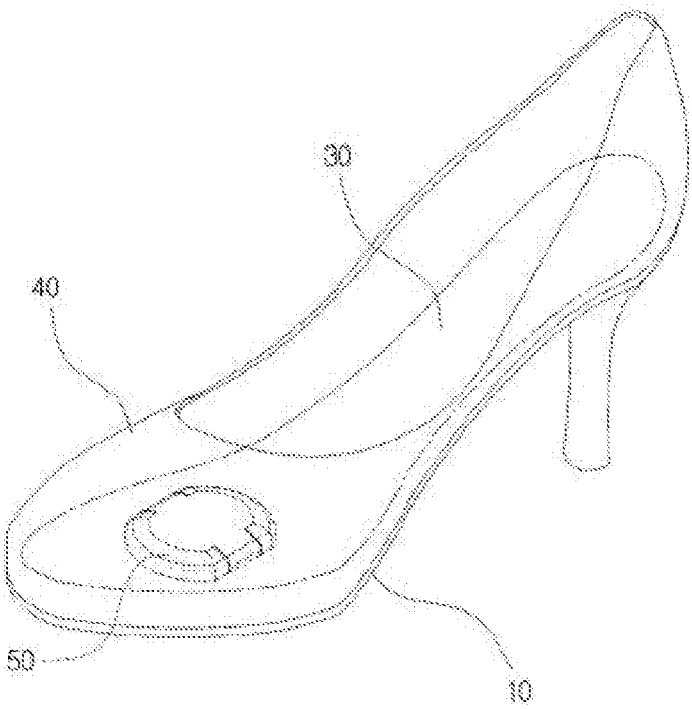
FIG. 1 is an overall perspective view showing a shoe having a vibration generating means accommodated therein according to the related art.
Figure 2:
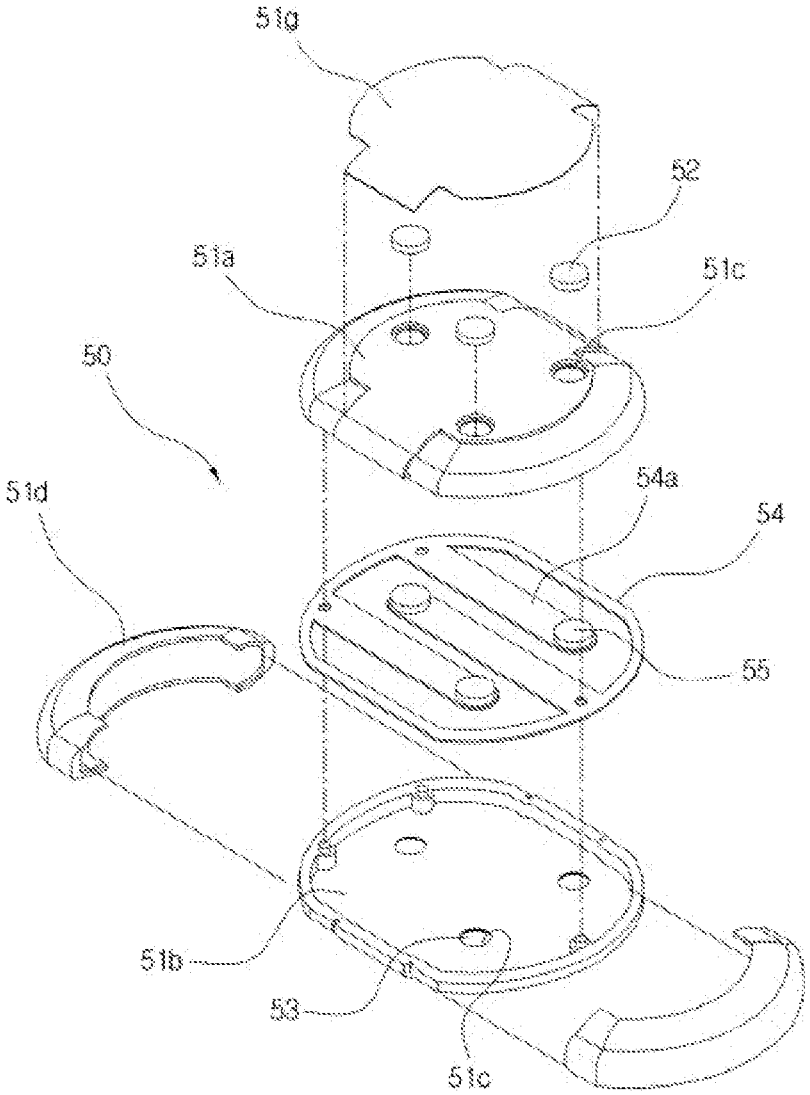
FIG. 2 is an exploded perspective view of the vibration generating means applied to FIG. 1.
Figure 3:
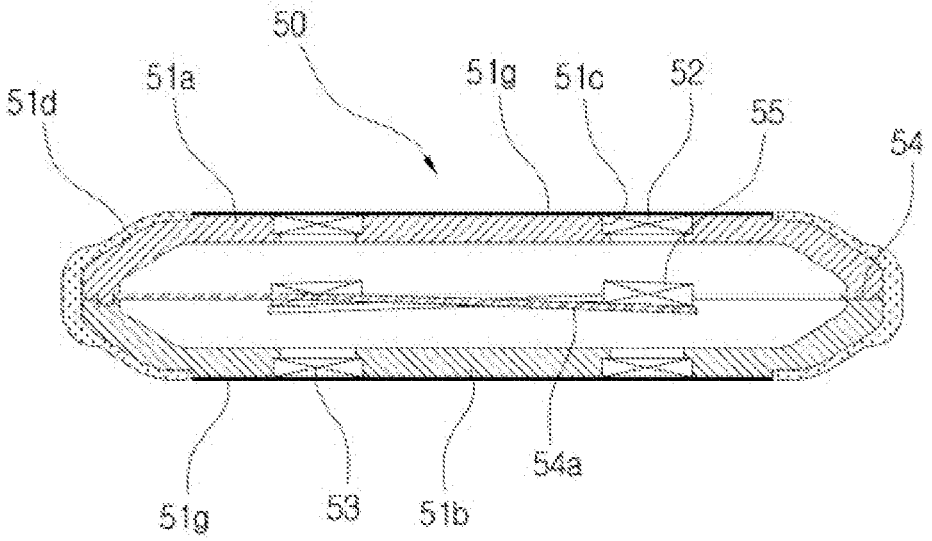
FIG. 3 shows a cross-sectional view showing the vibration generating means.
Figure 4:
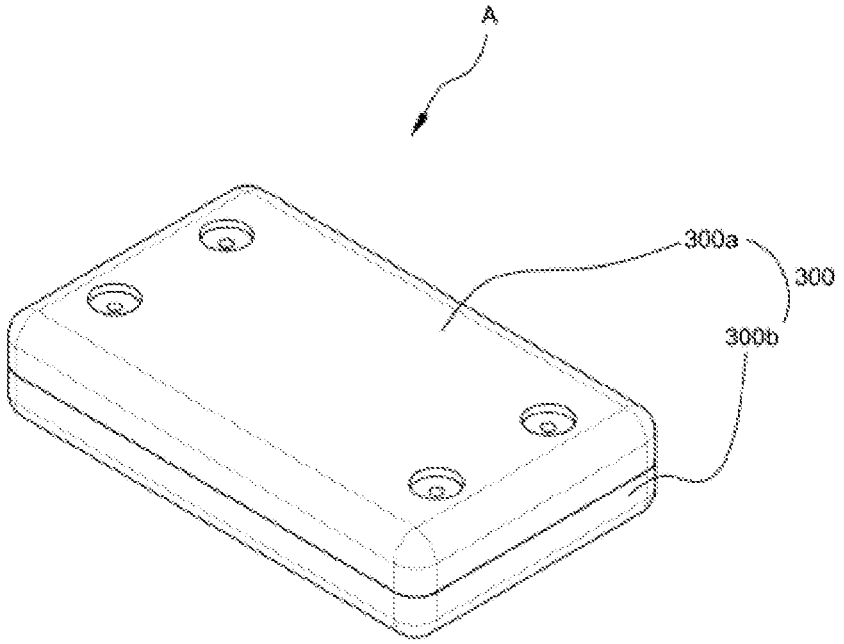
FIG. 4 is an external perspective view showing a vibration generator according to the present invention.
Figure 5:
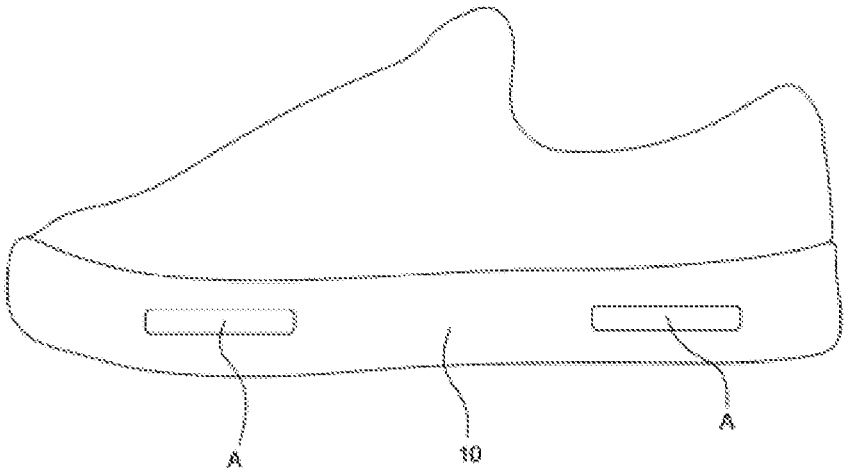
FIG. 5 is an exemplary view showing a case where a vibration generator is accommodated in a sole.
Figure 6:
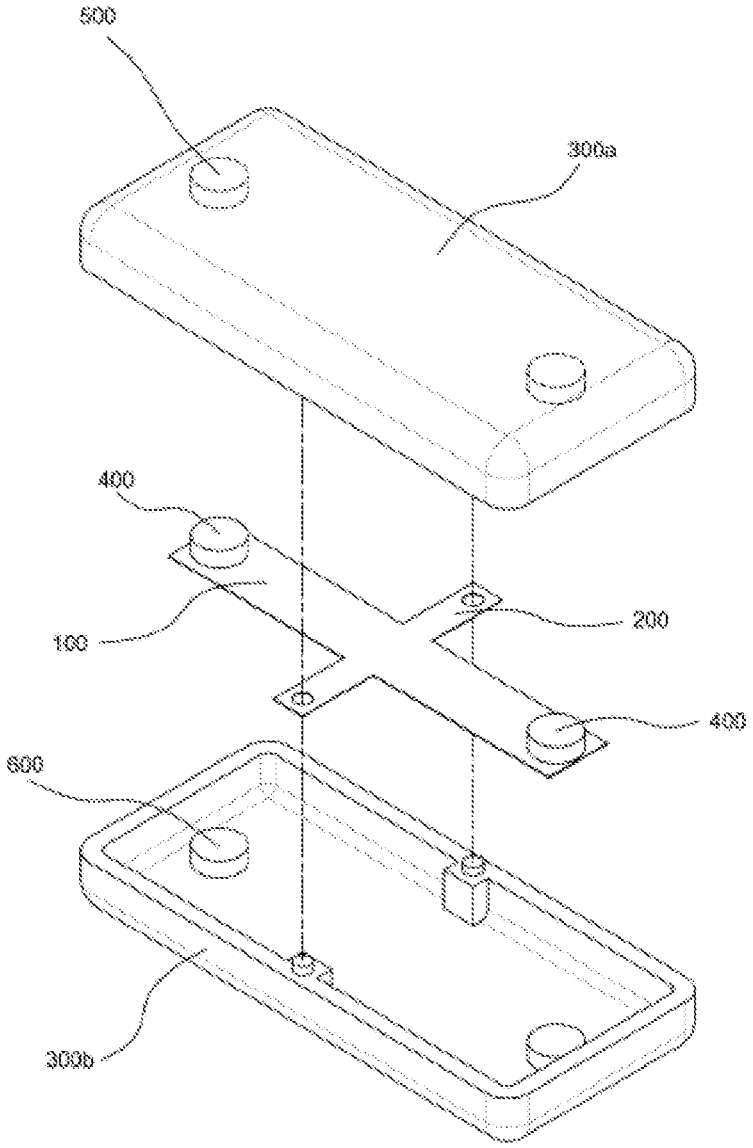
FIG. 6 is an exploded perspective view showing a basic configuration of a vibration generator according to the present invention.
Figure 7:
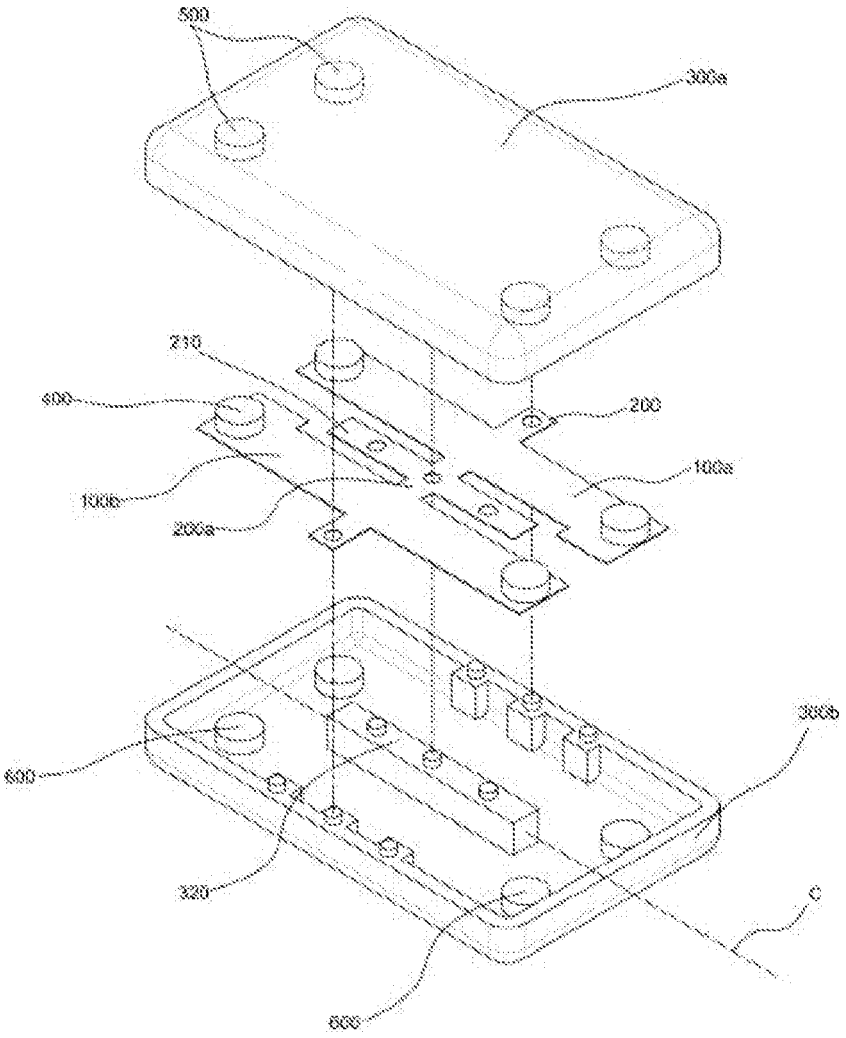
FIG. 7 is an exploded perspective view showing a vibration generator according to a first embodiment of the present invention.
Figure 8:
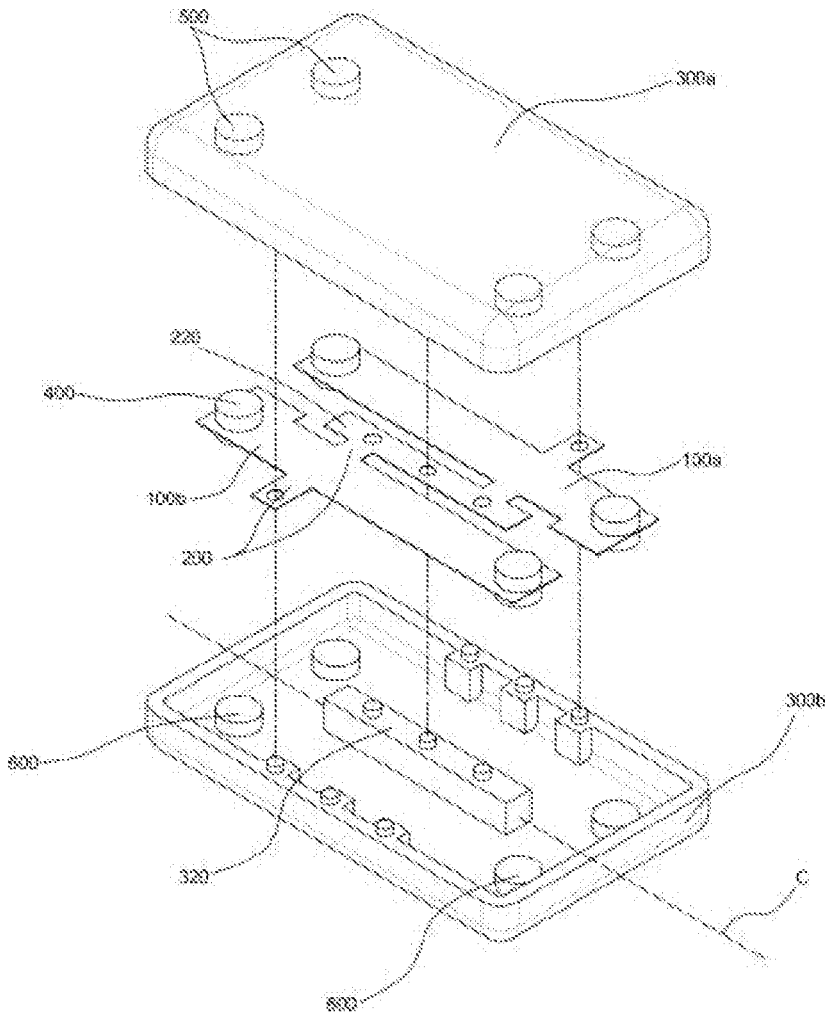
FIG. 8 is an exploded perspective view showing a vibration generator according to a second embodiment of the present invention.
Figure 9:
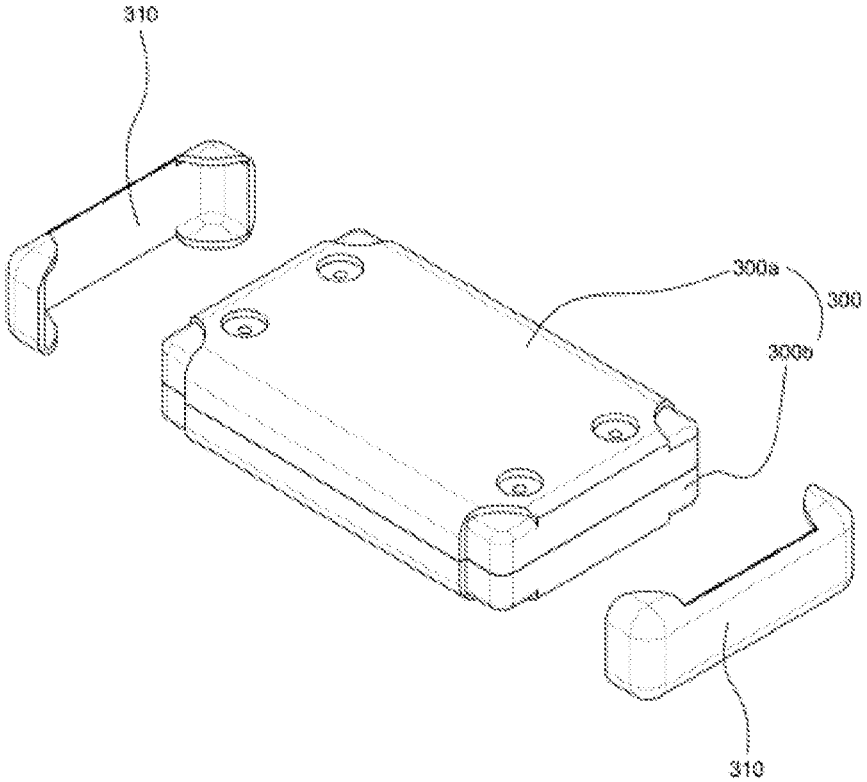
FIG. 9 is an exemplary view showing an assembly holder for assembling upper and lower cases.

Hereinafter, a vibration generator and a shoe having the same according to the present invention will be described in more detail, and reference will be made to the accompanying drawings. However, the drawings and specific descriptions thereof describe one practical example according to the technical spirit of the present invention, and the technical protection scope of the present invention is not limited thereto. The vibration generator according to the present invention may be accommodated in clothes or footwear which a person wear, and may also be used for the purpose of transmitting vibration in a direct or indirect manner to the person. Although a specific embodiment of the vibration generator according to the present invention is applied to a shoe, the shoe is limited to only one example in which the vibration generator may be applied. FIG. 4 is an external perspective view showing the vibration generator according to the present invention; FIG. 5 is an exemplary view showing a case where a vibration generator is accommodated in a sole; FIG. 6 is an exploded perspective view showing the basic configuration of a vibration generator according to the present invention; FIG. 7 is an exploded perspective view showing a vibration generator according to a first embodiment of the present invention; FIG. 8 is an exploded perspective view showing a vibration generator according to a second embodiment of the present invention; and FIG. 9 is an exemplary view showing an assembly holder for assembling upper and lower cases. The vibration generator according to the present invention includes, as a main component, a vibration plate 100, a support piece 200, an upper and lower casing 300, a core magnet 400, an upper magnet 500, and a bottom magnet 600. The vibration plate 100 is preferably made of a metal material, and is prepared by cutting a thin plate-type body into a predetermined shape. In particular, the vibration plate 100 is formed in a plate-type shape having a length longer than the width thereof, and the support piece 200 is formed to horizontally protrude in the widthwise direction of the vibration plate 100, the vibration plate 100 having a first end portion and an opposing second end portion along the lengthwise direction. The upper and lower casing 300 is provided to accommodate the vibration plate 100 therein and is configured so that an upper casing 300*a* and a lower casing 300*b* may be individually formed and then combined with each other, to form an empty space therein. Each end portion of the support piece 200 horizontally protruding in the widthwise direction of the vibration plate 100 is provided in such a manner as to be restricted at the coupling surface between the upper casing 300*a* and the lower casing 300*b*. The upper and lower casing 300 may be easily assembled by fitting assembly holders 310 into both left and right ends thereof, as shown in FIG. 9. The support piece 200 makes it possible for the vibration plate 100 to be accommodated in the upper and lower casing 300 with both longitudinal end portions of the vibration plate 100 being free end portions. The core magnet 400 is provided in one or more of end portions of the vibration plate 100 in the lengthwise direction. That is, the core magnet 400 may be provided in any one of end portions of the vibration plate 100 or both end portions in the lengthwise direction. Upper magnets 500 are fixed to the upper casing 300*a* so as to face the core magnets 400, to generate repulsive force. In addition, bottom magnets 600 are fixed to the lower casing 300*b* as to face the core magnets 400, to generate repulsive force. The vibration generator according to the present invention is provided such that both longitudinal ends of the vibration plate 100 installed inside the upper and lower casing 300 form free end portions in an unrestricted state, the core magnet 400 is provided in one or two places of the end portions, and the upper magnets 500 are fixed to the upper casing 300*a* and the lower magnets 600 are fixed to the lower casing 300*b*, in correspondence to the core magnets 400, thereby effectively inducing vibration by the repulsive force of the magnets. In particular, the support piece 200 horizontally protruding in the widthwise direction of the vibration plate 100 is restricted, so that both longitudinal end portions of the vibration plate 100, which form free end portions, are provided inside the upper and lower casing 300, whereby vibration is generated at both end portions of the vibration plate 100 in the lengthwise direction. That is, the vibration plate 100 installed inside the upper and lower casing 300 is in a suspending state. More specifically, the vibration plate 100 has both longitudinal end portions formed in free end portions and thus is in a suspending state, thereby ensuring that the vibration is induced at both end portions. In addition, the vibration plate 100 may be horizontally asymmetric with respect to the center thereof. When the vibration plate 100 is horizontally asymmetric, the vibration plate has weights horizontally different from each other with respect to the center, although it is small, and thus facilitates forming a larger vibration. Meanwhile, as shown in FIG. 7, the vibration generator according to the present invention may include two or more vibration plates 100, in which the two or more vibration plates 100 may be disposed parallel to each other inside the upper and lower casing 300. When two vibration plates are used, compared to when one vibration plate 100 is used, the vibration generator may cause greater vibration. When three vibration plates are provided, the vibration generator may cause greater vibration compared to when two vibration plates are used. The number of vibration plates 100 constituting one vibration generator can be suitably selected and applied, considering the size of the upper and lower casing 300 or the required level of vibration. This embodiment shows a case where two vibration plates 100 are used, in which the first vibration plate 100*a* and the second vibration plate 100*b* are disposed parallel to each other. Preferably, inward portions of the first vibration plate 100*a* and the second vibration plate 100*b* are connected using a shared support piece 200*a*. That is, the first vibration plate 100*a* and the second vibration plate 100*b* are connected to each other by the shared support piece 200*a*. In addition, when the first vibration plate 100*a* and the second vibration plate 100*b* are connected to each other by the shared support piece 200*a*, a support block 320 is formed to protrude along the center line C of the upper and lower casing 300, thereby causing the shared support piece 200*a* to be supported by the support block 320. More preferably, the shared support piece 200*a* is formed in a direction perpendicular to the first vibration plate 100*a* and the second vibration plate 100*b*, which are parallel to each other. An extension piece 210 may be further formed in a direction that is parallel to the first vibration plate 100*a* and the second vibration plate 100*b* and is perpendicular to the shared support piece 200*a*, in which the extension piece 210 is also supported by the support block 320. The shared support piece 200*a* and the extension piece 210 extending therefrom are supported by the support block 320, so that the first vibration plate 100*a* and the second vibration plate 100*b* are connected to each other, but individually induce the vibration. Meanwhile, as shown in FIG. 8, when the first vibration plate 100*a* and the second vibration plate 100*b* are arranged in parallel, the support piece 200 protruding in the widthwise direction of each vibration plate 100*a* and 100*b* may be formed near the end portion, rather than the center, in the lengthwise direction of the first vibration plate 100*a* and the second vibration plate 100*b*. Preferably, the support piece 200 protruding from the first vibration plate 100*a* and the support piece 200 protruding from the second vibration plate 100*b* are formed in opposite directions to each other, and inward portion of each support piece 200 is supported by a support block 320 protruding along the center line C of the upper and lower casing 300. Because the support piece 200 formed from the first vibration plate 100*a* and the support piece 200 formed from the second vibration plate 100*b* are positioned in different positions, inward portion of each support piece 200 may be individually supported by the support block 320, and the inward portions of the support pieces 200 formed at different positions are interconnected using a connecting piece 220, considering the convenience of assembly, whereby the first vibration plate 100*a* and the second vibration plate 100*b* may be formed in an integral manner. Since the inward portions of two support pieces 200 formed at different positions are connected using the connecting piece 220, it is preferable that the connecting piece 220 is installed to be supported by the support block 320. A case where the vibration generator according to the present invention described above is actually used in such a manner as to be accommodated in a shoe will be described. When a person walks while wearing shoes in which vibration generator A is accommodated, the vibration plate 100 of the vibration generator A is moved. When the vibration plate 100 moves up and down, the vibration plate 100 rapidly vibrates up and down, due to the interaction between the core magnet 400 and the upper magnet 500 and the bottom magnet 600, whereby it is possible to generate enough vibration that a person can feel, and thus to provide a beneficial effect to the person. Meanwhile, since the core magnet 400, the upper magnet 500, and the bottom magnet 600 are accommodated in the vibration generator A, the magnetic force may affect the human body, which may provide a beneficial effect such as improved blood circulation. That is, low frequency due to vibration generated from the vibration generator A is transmitted to the human body. Especially when the vibration generator A is accommodated in the shoe, the vibration generator A may transmit the low frequency through the soles of feet and thus provide a massage effect to the soles of feet, whereby it is possible to help improving overall functions of the human body, such as relieving fatigue of the feet, facilitating blood circulation, etc. In particular, diabetics are required to be careful of even a slight wound, and do not have proper blood circulation in their feet while wearing shoes and thus suffer greatly compared to ordinary people. Therefore, when people with diabetes or people with reduced body function wear shoes in which the vibration generator A is accommodated according to the present invention, they can maintain and improve their health. Meanwhile, the vibration generator A according to the present invention is installed in clothes or shoes, which are worn by a user. For example, vibration generator A is accommodated inside a shoe sole 10, as shown in FIG. 5, and preferably is installed in the midsole constituting the shoe sole. Since the vibration generator A according to the present invention has excellent vibration generation characteristics and can be manufactured in compact, the vibration generator A may be installed in the forefoot as well as the rear of the shoe sole 10. That is, according to the present invention, the vibration generator is installed in the shoe sole and the shoe equipped with the vibration generator may be manufactured. The user can benefit not only the health of the feet but also the health of the whole body, just by enjoying walking with the shoes on.

The vibration generator according to the present invention is installed in clothes or footwear worn by human and thus utilized as a multi-purpose vibration generator, which is capable of providing a beneficial effect to the human body.

The invention claimed is:

1. A vibration generator, comprising:

a vibration plate of a plate type having a length longer than a width thereof, the vibration plate having a first end portion and an opposing second end portion along a lengthwise direction;

support pieces horizontally protruding in a widthwise direction of the vibration plate, the support pieces being disposed between the first end portion and the opposing second end portion of the vibration plate;

upper and lower casings coupled while restricting each end portion of each support piece, so as to accommodate the vibration plate therein;

core magnets fixedly provided in one or more of end portions in a lengthwise direction of the vibration plate;

upper magnets fixed to the upper casing so as to face the core magnets, thereby generating a repulsive force;

bottom magnets fixed to the lowercasing so as to face the core magnets, thereby generating a repulsive force.

2. The generator of claim 1, wherein the vibration plate is accommodated in a suspending state inside the upper and lower casings.

3. The generator of claim 1, wherein the vibration plate is horizontally asymmetric.

4. The generator of claim 1, wherein the vibration plate includes two or more vibration plates provided in parallel.

5. The generator of claim 4, wherein the vibration plate is provided so that inward portions of a first vibration plate and a second vibration plate are connected by a shared support piece.

6. The generator of claim 5, wherein the shared support piece is supported by a support block protruding along a center line of the upper and lower casings.

7. The generator of claim 6, wherein the shared support piece is provided so that an extension piece extends from the shared support piece in an intersecting manner, in which the extension piece is also supported by the support block.

8. The generator of claim 4, wherein the vibration plate is provided so that the first vibration plate and the second vibration plate are arranged in parallel, and the support piece is formed near any end portion in a lengthwise direction of a first vibration plate and a second vibration plate.

9. The generator of claim 8, wherein the support piece protruding from the first vibration plate and the support piece protruding from the second vibration plate are formed in opposite directions to each other, and inward portions of the support pieces are supported by a support block protruding along a center line of the upper and lower casings.

10. The generator of claim 9, wherein the inward portions of the support pieces are interconnected by a long connecting piece, in which the connecting piece is supported by the support block.

11. A shoe comprising:

a sole;

an upper; and the vibration generator of claim 1, wherein the vibration generator is accommodated in the sole.

* * * * *